US005651854A

United States Patent [19]

Shimamura et al.

[11] Patent Number: 5,651,854

[45] Date of Patent: Jul. 29, 1997

[54] JOINT ASSEMBLY OF A LEADER AND A FILM AND SPLICER FOR MAKING THE SAME

[75] Inventors: Yasunobu Shimamura; Masayuki Kobayashi; Takuya Yamamoto, all of Wakayama, Japan

[73] Assignee: Noritsu Koki Co., Ltd., Wakayama, Japan

[21] Appl. No.: 399,214

[22] Filed: Mar. 6, 1995

[30] Foreign Application Priority Data

Mar. 4, 1994 [JP] Japan ..... 6-034800

[51] Int. Cl.[6] ..... B65H 21/00

[52] U.S. Cl. ..... 156/502; 156/157; 156/159; 156/513

[58] Field of Search ..... 156/157, 159, 156/304.3, 304.5, 502, 505, 513

[56] References Cited

U.S. PATENT DOCUMENTS

| | | | |
|---|---|---|---|
| 4,166,300 | 9/1979 | Savich | 156/513 X |
| 5,078,828 | 1/1992 | Marglin | 156/502 X |
| 5,123,992 | 6/1992 | Kanda et al. | 156/159 X |
| 5,279,696 | 1/1994 | Zangenfeind et al. | 156/502 X |
| 5,354,408 | 10/1994 | Otomine et al. | 156/513 X |

FOREIGN PATENT DOCUMENTS

| | | | |
|---|---|---|---|
| 2641373 | 3/1978 | Germany | 156/502 |
| 551217 | 2/1943 | United Kingdom | 156/157 |

*Primary Examiner*—Mark A. Osele
*Attorney, Agent, or Firm*—Wenderoth, Lind & Ponack

[57] ABSTRACT

A splicer bed has a leader support on a top thereof. An opening is provided in one end of the leader support. A knife mounting base is arranged to project from the opening and is provided at one end with a cartridge holder. The knife mounting base has a leader positioning head provided on the other end thereof for determining the position of a leader. A stationary knife is mounted to the leader positioning head. A movable knife is mounted for pivotal movement to the stationary knife. A film holddown plate is pivotably mounted to the knife mounting base. The knife mounting base is provided with a pair of punches which are arranged slidably and can be lowered by the film holddown plate. Before the leading portion of a film is drawn out from a film cartridge loaded in the cartridge holder is held under the film holddown plate, the downward movement of the film holddown plate causes the punches to cut two notches in both side edges of the film. The leading portion of the film is trimmed by the downward action of the movable knife and then is joined by a strip of splicing tape to the leader placed on the leader support.

4 Claims, 6 Drawing Sheets

JOINT ASSEMBLY OF A LEADER AND A FILM AND SPLICER FOR MAKING THE SAME

BACKGROUND OF THE INVENTION

The present invention relates to a joint assembly of a leader and a photographic film for ease of the film being transferred to a development station as guided with the leader and to a splicer for making the joint assembly.

In a common automatic photographic film development apparatus using a leader transfer system, a leader L is joined at its trailing end to the leading end of a film F fed out from a cartridge (not shown) by a strip of splicing tape T, as shown in FIG. 7 (I), so that the film F is passed through the development apparatus while being guided by the leader L.

The leader L is made of a flexible resin material sheet having a row of square perforations a provided at equal intervals in one edge thereof for engagement with a sprocket of the development apparatus lengthwisely of the film F.

A leading portion of the film F with the leader L is separated by cutting along the line denoted by C in FIG. 7(I) after the development process of the film F. The remaining film F less the leader L is then fed into a negative film mask in the exposure station of a printer machine.

For removing the leader L, the leading portion of the film F is cut at a right angle to the feeding direction. Hence, the resultant leading end of the remaining film F has a pair of square corners D as shown in FIG. (II). When the leading end of the film F is directly inserted into the negative film mask, its square corners may possibly be deflected and bent causing jamming in the negative film mask of the exposure station. This will prevent smooth running of the film F through the printer machine.

It is thus a first object of the present invention to provide an improved joint assembly of a leader and a film for ease of the film being transferred and passed smoothly through a negative film mask.

It is a second object of the present invention to provide a splicer for making with ease such a joint assembly of a leader and a film so that the film can be transferred without jamming.

SUMMARY OF THE INVENTION

For accomplishing the first object of the present invention, a joint assembly of a leader and a film is fabricated by joining a leading end of the film to a trailing end of the leader made of a flexible material. The film has a pair of notches provided at both sides of a leading portion thereof for ease of separation after a development process of the film.

For achieving the second object of the present invention, a splicer for forming such joint assembly includes a splicer bed having a leader support arranged on the top thereof, the leader support having an opening provided in one end thereof. A knife mounting base is arranged to project from the opening and has a cartridge holder disposed on one end thereof for holding a film cartridge and having a leader positioning head provided on the other end thereof for determining the placement of a leader on the leader support. A stationary knife is mounted below the leader positioning head. A movable knife is mounted for pivotal movement to the stationary knife so that the knives can cut off the leading portion of a film. A film holddown plate is pivotably mounted to the knife mounting base for holding down the leading portion of the film drawn out from the film cartridge loaded in the cartridge holder towards the leader support. A pair of punches are accommodated in two pin holes provided in the knife mounting base beneath the film holddown plate and remain urged upwardly by biasing members so that when the film holddown plate is lowered, it presses down the two punches which in turn produce two notches in the leading portion of the film.

According to the above first aspect of the present invention, the film is separated from the leader after the development process by cutting the leading portion of the film between the two notches. As a result, a cut end of the film has two corners that are not squared but are rounded, thus ensuring smooth feeding and transfer of the film.

According to the second aspect of the present invention, the leading portion of the film drawn out from the film cartridge loaded in the cartridge holder is trimmed by the pivotal downward movement of the movable knife across the stationary knife while it is securely held under the film holddown plate.

Before the film holddown plate has been lowered to hold the leading portion of the film, it presses down the two punches. More specifically, the two notches of the leading portion of the film are produced by the punches during the downward movement of the film holddown plate which can be synchronous with the downward movement of the movable knife.

After trimming of the film, the leader is placed in position on the leader support. As the leader stays in direct contact with the leader positioning head, it is joined to the leading end of the film by a strip of splicing tape thus forming a joint assembly of the leader and the film.

DETAILED DESCRIPTION OF THE PREFERRED EMBODIMENTS

Figure 1:
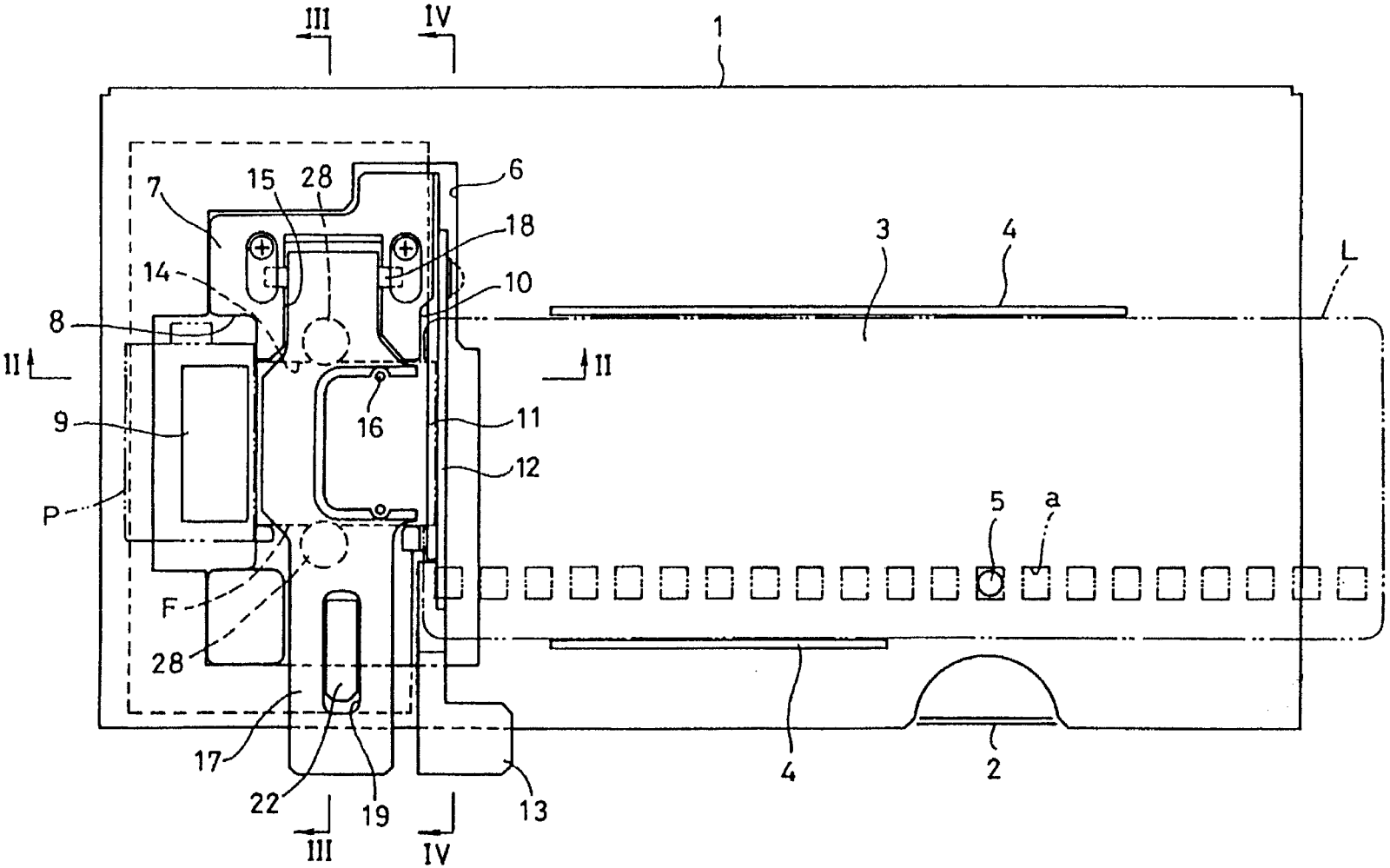
FIG. 1 is a plan view of an embodiment of a splicer according to the present invention.
Figure 2:
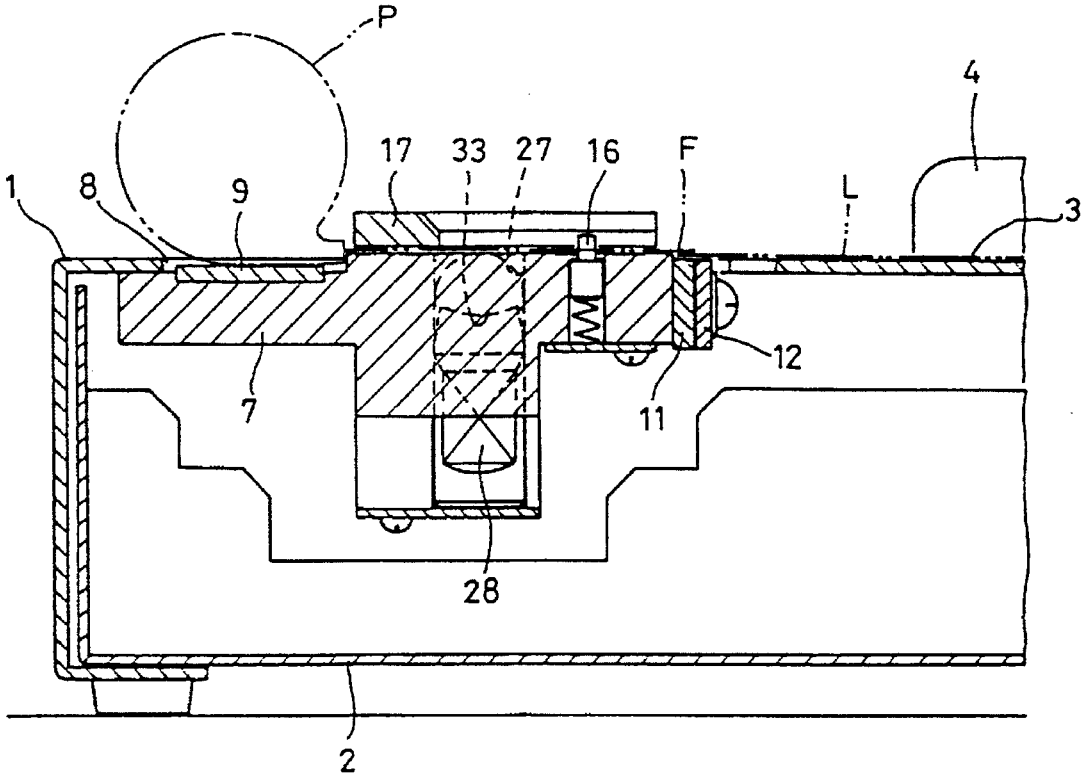
FIG. 2 is a cross sectional view taken along the line II—II of FIG. 1.
Figure 3:
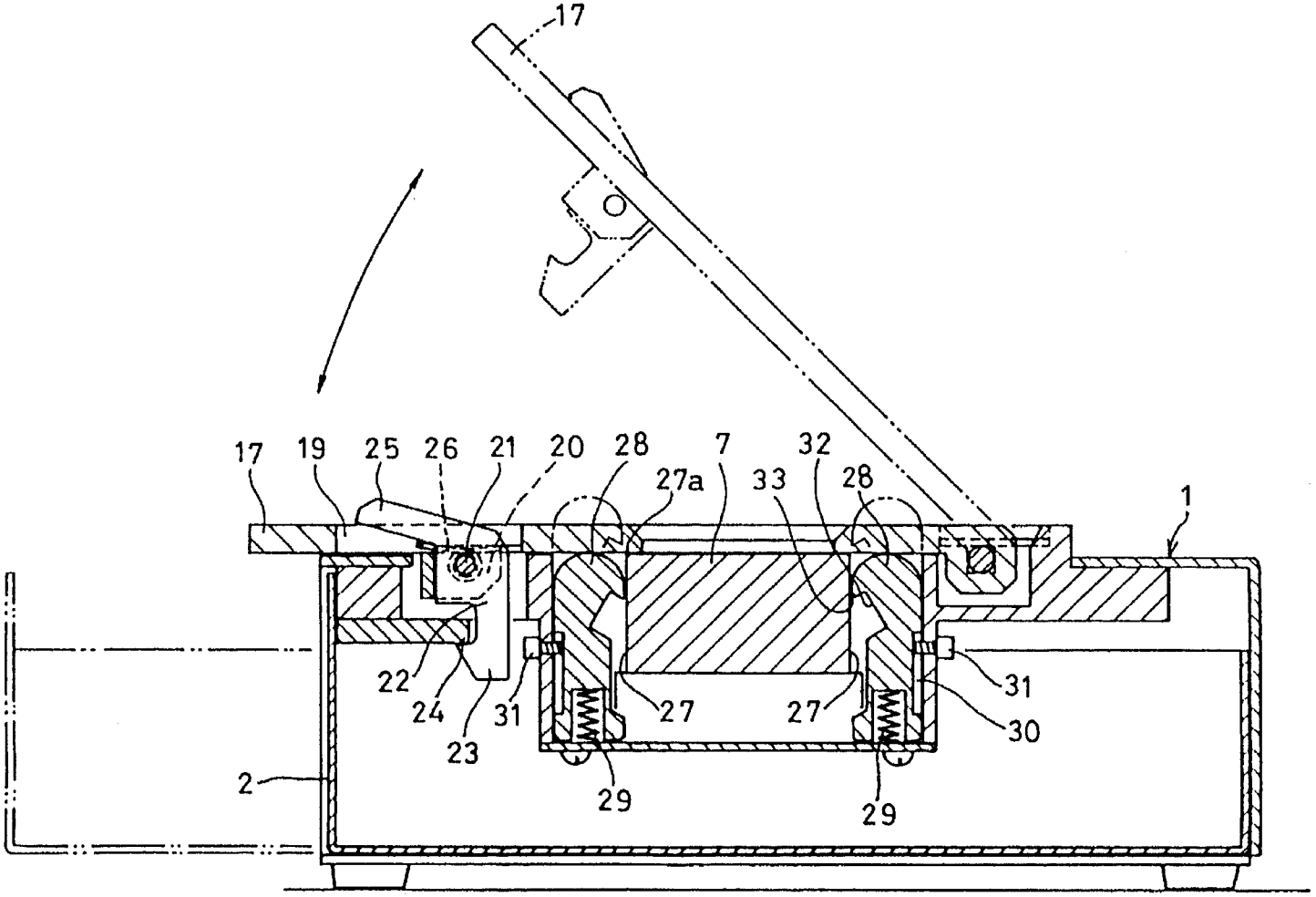
FIG. 3 is a cross sectional view taken along the line III—III of FIG. 1.
Figure 4:
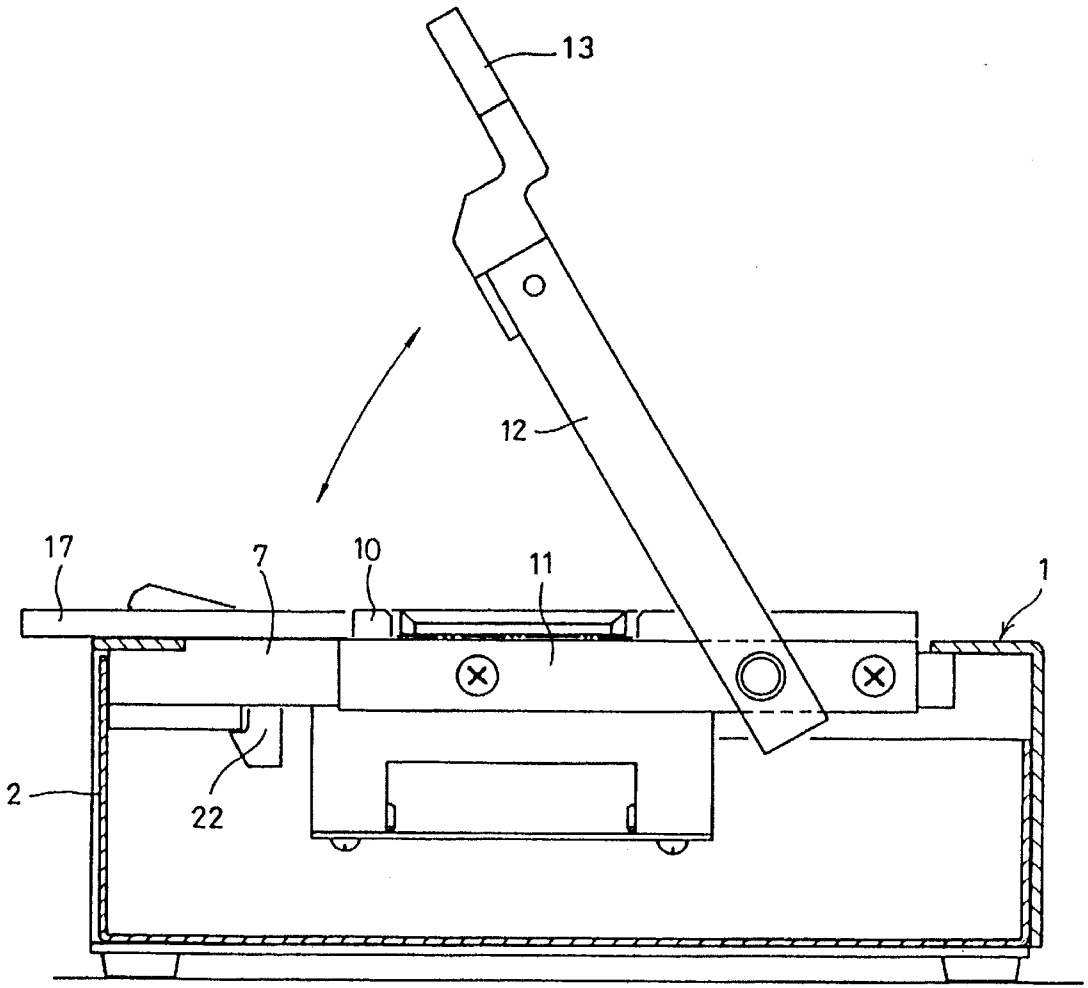
FIG. 4 is a cross sectional view taken along the line IV—IV of FIG. 1.

Preferred embodiments of the present invention referring to FIGS. 1 to 6.

As shown in FIGS. 1 to 4, a splicer bed 1 is formed of a box shape having two openings provided in a side and a bottom thereof and accommodating a slidable drawer 2 in an interior space thereof. The top surface of the splicer bed 1 serves as a leader support 3 on which a leader L is placed. Mounted on the leader support 3 are a pair of leader guides 4 of plate shape for positioning the leader L from both sides and a leader positioning pin 5 arranged engageable with each of a row of square perforations provided in one edge of the leader L.

The leader support 3 has at one end an opening 6 in which a knife mounting base 7 is accepted and fixedly mounted by screws or like to the splicer bed 1 so that the top of base 7 is flush with the leader support 3.

The knife mounting base 7 has a recess in one side of the top thereof which serves as a cartridge holder 8. A magnet 9 is mounted in the bottom of the cartridge holder 8. A leader positioning head 10 is provided on the other end of the knife mounting base 7 for determining the setting location of a joint end of the leader n placed on the leader support 3.

A stationary knife 11 is mounted beneath the leader positioning head 10 and a movable knife 12 is mounted to one end of the stationary knife 11 for trimming a leading portion of a film F. The movable knife 12 has a handle grip 13 mounted to the distal end thereof.

The top of knife mounting base 7 has a film recess 14 for accepting the film F drawn out from a film cartridge P held in the cartridge holder 8 and a holddown plate recess 15 extending at a right angle to the film recess 14.

Figure 5:
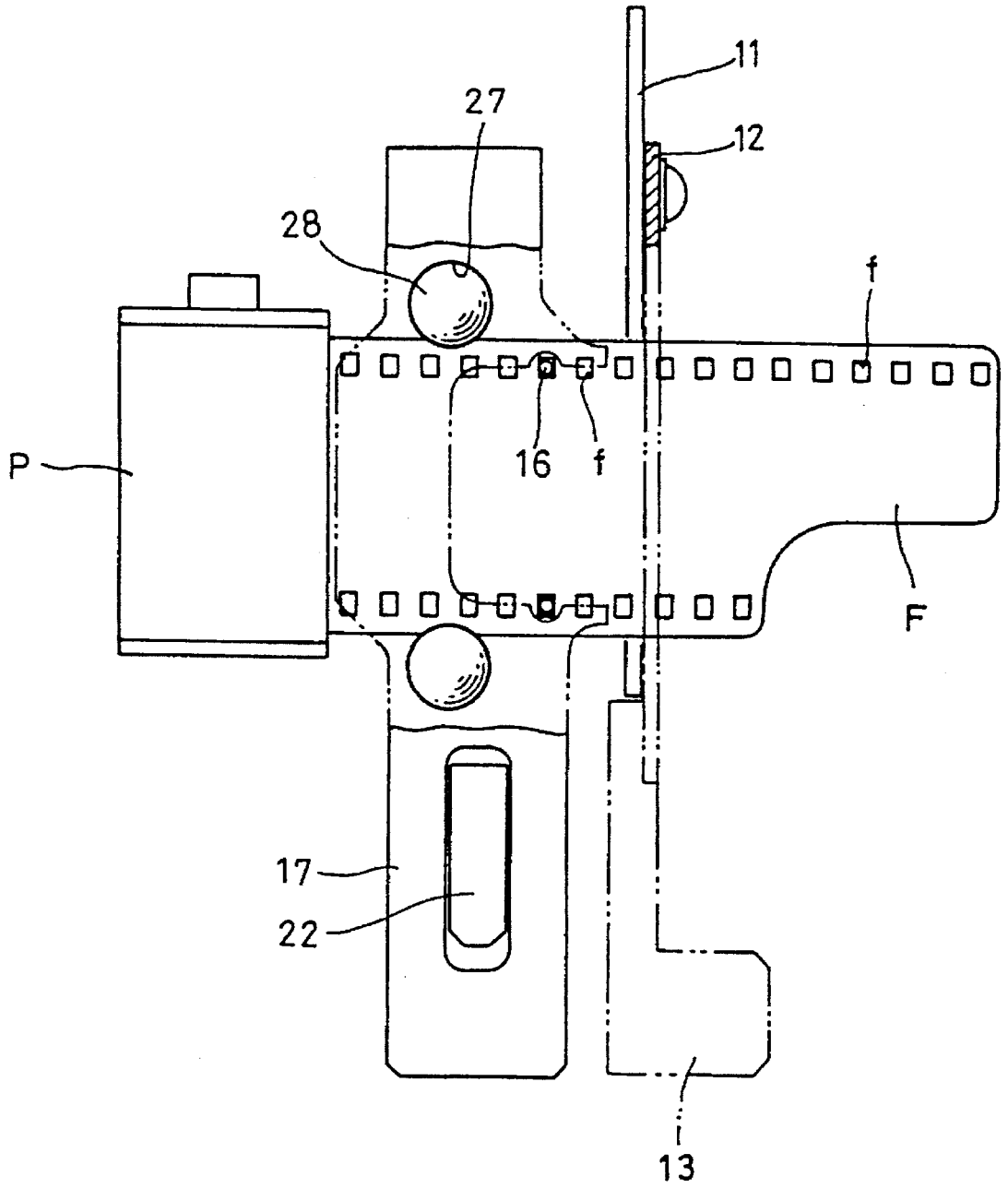
FIG. 5 is a plan view showing notches provided in a film.

A pair of film positioning pins 16 are mounted in the film recess 14 for engagement with two rows of perforations f respectively arranged in both edges of the film F, as best shown in FIG. 5.

A film holddown plate 17 is located in the holddown plate recess 15 and pivotably mounted at one end by a pin 18 to the knife mounting bed 7.

The film holddown plate 17 has a slot 19 provided in the other end thereof for allowing the pivotal movement of a latch 22 that is mounted for pivotal movement by a pin 21 between a pair of supports 20 which are located on both sides of the slot 19.

The latch 22 has a hook portion 23 provided at one end thereof for engagement with a receptor 24 mounted beneath the splicer bed 1. When the hook portion 23 is engaged with the receptor 24, the film holddown plate 17 presses against the leading end of the film F in the film recess 14.

The latch 22 also has an operating portion 25 provided at the other end thereof for movement across the slot 19. When the operating portion 25 is depressed, the latch 22 performs a pivotal action thus disengaging its hook portion 23 from the receptor 24. A spring 26 urges the latch 22 to pivot to engage hook portion 23 with the receptor 24.

A pair of punch openings or pin holes 27 are provided in base 7 at the bottom of the holddownplate recess 15 so that upper edges act as notching blades 27*a*. Each of the punch openings 27 accommodates a punch 28 which is lowered by the downward movement of the film holddown plate 17. The punch 28 remains urged upwardly by a biasing member 29.

The punch 28 has an axially extending guide recess 30 provided in a side wall thereof. A pin 31 is inwardly mounted to fit in the guide recess 30 so that the punch 28 is prevented from slipping out from the punch opening 27. More specifically, when the punch 28 comes to its upper limit of movement, it is directly held at the lower end of its guide recess 30 by the pin 31.

The punch 28 also has a deep recess 32 provided therein, deep enough to clear the film F, forming a punch blade 33 which comes out of the punch opening 27 when the punch 28 is at its uppermost location.

After the film cartridge P is loaded into the cartridge holder 8, the film F is drawn out from the film cartridge P. The film F is then placed in the film recess 14 with the film positioning pins 16 fitting in the perforations f of the film F. While the film holddown plate 17 is being lowered, it presses down the two punches 28. Accordingly, the punches 28 cut out partial circular notches h in both edges of the film F (See FIGS. 5 and 6(A)).

When the film holddown plate 17 comes down to press the film F against the bottom of the film recess 14, the hook portion 23 of the latch 22 engages with the receptor 24. As a result, the film F is held securely under the film holddown plate 17.

While the film F is being held, its leading portion is separated by a cutting action of the movable knife 12 and the stationary knife 11.

During the cutting action, the film F remains held under the film holddown plate 17 and is prevented from being deflected. This produces an accurately square cutting of the end of the film F.

Figure 6A:
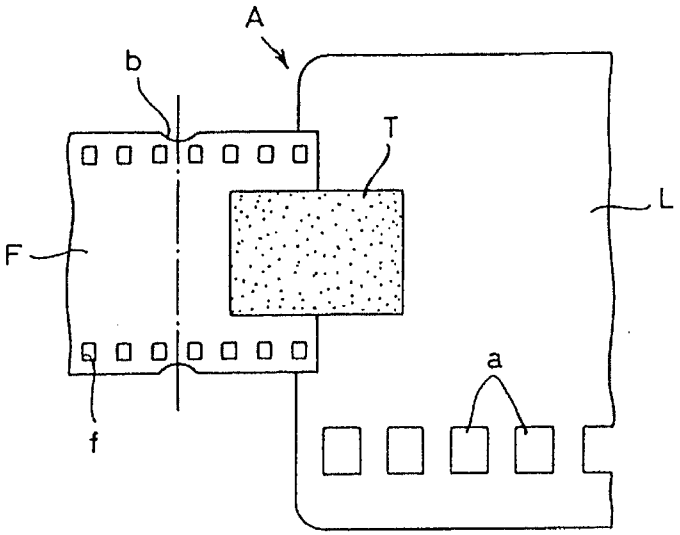
FIGS. 6(A) and 6(B) are plan views respectively showing a joint assembly of a leader and a film and a remaining portion of the film less a removed leading portion.

Then, the leader L is placed on the leader support 3 with its joint end directly facing the leader positioning head 10. Simultaneously, the leader positioning pin 5 is located in one of the square perforations a of the leader L. After a strip of splicing tape T is bonded between the film F and the leader L, a Joint assembly A shown in FIG. 6(A) is formed.

During the bonding of the tape T between the film F and the leader L, neither the film F nor the leader L will be dislocated but rather are secured in their relative locations. This ensures bonding with accuracy.

Figure 6B:
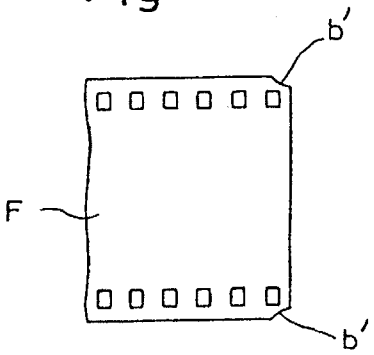
Figure 7A:
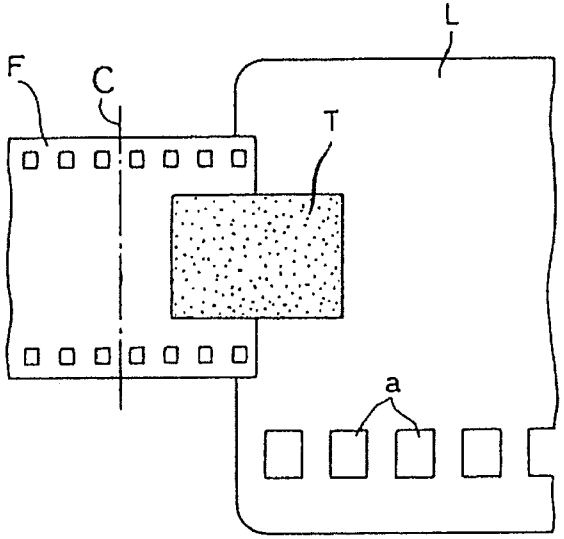
Prior Art Fig. 7A
FIGS. 7(A) and 7(B) are plan views respectively showing a prior art joint assembly of a leader and a film and a remaining portion of the film less a removed leading portion.
Figure 7B:
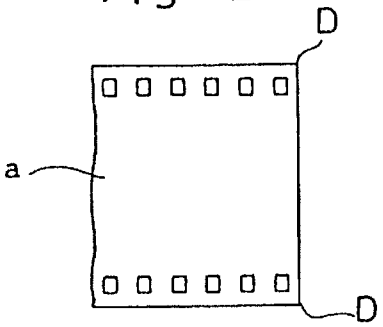
Prior Art Fig. 7B

The film F and the leader n are transferred and guided to a film development apparatus. When the film F has been subjected to a development process, it is separated from the leader L by cutting between the two notches b. As the result, a cut end of the film F has two blunt corners b' as shown in FIG. 6(B). Accordingly, the film F can be loaded to a negative film mask for printing with its leading end kept free from bending or jamming, since it can be inserted smoothly without difficulty.

The blunt corners b1 of the leading end of the film F are not limited to the shape of the embodiment shown in FIG. 6(B) but any appropriate shape can be employed with equal success corresponding to the shape of the notching blades 27*a*.

What is claimed is:

1. A splicer for forming a joint assembly, said splicer comprising:

a splicer bed having a top having a leader support arranged thereon, said leader support having an opening provided in one end thereof;

a knife mounting base arranged to project from said opening and having a cartridge holder disposed on one end thereof for holding a film cartridge;

a leader positioning head provided on another end of said knife mounting base for determining the position of a leader on said leader support;

a stationary knife mounted at a level lower than said leader positioning head;

a movable knife mounted for pivotal movement to the stationary knife so that both said knives can cut off a leading portion of a film drawn out from a film cartridge to be loaded on said cartridge holder;

a film hold-down plate pivotably mounted to said knife mounting base for holding down the leading portion of the film drawn out from the film cartridge towards said leader support; and a pair of punches accommodated in two pin holes provided in said knife mounting base beneath said film hold-down plate and remaining urged upwardly by biasing members so that when said film holddownplate is lowered, it presses down said two punches which in turn produce two respective notches in the leading portion of the film.

2. A splicer as claimed in claim 1, wherein said leader positioning head and said stationary knife are relatively positioned such that when a leader is positioned on said leader support with a trailing end of the leader abutting said leader positioning head the trailing end of the leader is supported on said stationary knife.

3. A splicer as claimed in claim 1, wherein each said punch has therein a guide recess, and further comprising a pin projecting from said knife mounting base into said guide recess, thereby limiting the extent of movement of said punch relative to the respective said pin hole.

4. A splicer as claimed in claim 1, wherein each said punch has a recess defining a punch blade for forming a respective notch in the film.

* * * * *